US007915766B2

(12) United States Patent
Hernandez et al.

(10) Patent No.: US 7,915,766 B2
(45) Date of Patent: Mar. 29, 2011

(54) PREVENTIVE MAINTENANCE TAPPING AND DUTY CYCLE MONITOR FOR VOLTAGE REGULATOR

(75) Inventors: Augusto D. Hernandez, Brookfield, WI (US); Augusto D. Hernandez, Jr., legal representative, Lutz, FL (US); Fred J. Rapant, South Milwaukee, WI (US); Richard J. Kaluzny, Greenfield, WI (US); Donald A. Down, Brookfield, WI (US)

(73) Assignee: Cooper Technologies Company, Houston, TX (US)

( * ) Notice: Subject to any disclaimer, the term of this patent is extended or adjusted under 35 U.S.C. 154(b) by 260 days.

(21) Appl. No.: 12/256,629

(22) Filed: Oct. 23, 2008

(65) Prior Publication Data

US 2009/0063063 A1 Mar. 5, 2009

Related U.S. Application Data

(60) Division of application No. 11/139,969, filed on May 31, 2005, now Pat. No. 7,482,714, which is a continuation of application No. 10/927,505, filed on Aug. 27, 2004, now abandoned.

(60) Provisional application No. 60/500,687, filed on Sep. 8, 2003.

(51) Int. Cl.
*H01H 9/30* (2006.01)
*H01H 1/60* (2006.01)

(52) U.S. Cl. ..... 307/137; 307/134; 307/135; 307/138

(58) Field of Classification Search ..... 307/134, 307/135, 137, 138
See application file for complete search history.

(56) References Cited

U.S. PATENT DOCUMENTS

| | | | | |
|---|---|---|---|---|
| 3,427,530 | A | 2/1969 | Oakes et al. | |
| 3,544,884 | A | 12/1970 | Prescott | |
| 4,530,607 | A | 7/1985 | Bungener | |
| 5,179,290 | A | 1/1993 | Page | |
| 5,450,002 | A | 9/1995 | Dunk | |
| 5,581,173 | A | 12/1996 | Yalla et al. | |
| 5,844,331 | A * | 12/1998 | Kieser et al. | 307/137 |
| 6,100,674 | A | 8/2000 | Dohnal et al. | |
| 6,124,726 | A | 9/2000 | Dohnal et al. | |
| 6,833,518 | B1 | 12/2004 | Byers et al. | |
| 6,921,989 | B2 * | 7/2005 | Baranowski et al. | 307/139 |

FOREIGN PATENT DOCUMENTS

WO WO 02/48730 6/2002

OTHER PUBLICATIONS

PCT International Search Report (Application No. PCT/US04/29289) mailed Oct. 1, 2007 (2 total pages).
PCT Written Opinion (Application No. PCT/US04/29289) mailed Oct. 1, 2007 (7 total pages).

* cited by examiner

*Primary Examiner* — Hal I Kaplan
(74) *Attorney, Agent, or Firm* — Fish & Richardson P.C.

(57) ABSTRACT

The life of load tap changer contacts is monitored by detecting an arcing event; identifying arcing surfaces involved in the arcing event; calculating a per-unit loss of life for the identified arcing surfaces as a result of the arcing event; updating estimates of cumulative erosion for the arcing surfaces; comparing the updated estimates of cumulative erosion to a first threshold value; and signaling for action when at least one of the updated estimates of cumulative erosion exceeds the first threshold value.

18 Claims, 5 Drawing Sheets

PREVENTIVE MAINTENANCE TAPPING AND DUTY CYCLE MONITOR FOR VOLTAGE REGULATOR

CROSS REFERENCE TO RELATED APPLICATIONS

This application is a divisional of (and claims the benefit of priority under 35 USC 121) to U.S. application Ser. No. 11/139,969, filed May 31, 2005, which is a continuation of U.S. application Ser. No. 10/927,505, filed Aug. 27, 2004, now abandoned, which claims the benefit of U.S. Provisional Application No. 60/500,687, filed Sep. 8, 2003. The disclosure of the prior applications are considered part of (and are incorporated by reference in) the disclosure of this application.

TECHNICAL FIELD

This document relates to a system for monitoring and maintaining a load tap changer in a voltage regulator.

BACKGROUND

A voltage regulator or load tap changer utilizes a tap changer that employs a secondary circuit detector to actuate a mechanical linkage that selectively engages taps of a tapped section of winding to maintain a substantially constant voltage on an output of the regulator in response to voltage variations on an input of the regulator. Arcing occurs during changes in the tap position, which results in some erosion of involved contacts. This contact erosion continues until maintenance is performed on the tap changer and the contacts are replaced, or until the contacts erode to a point where the contacts no longer make electrical contact with one another, resulting in an electrical outage. As a result, remaining contact life impacts maintenance schedules and service reliability of the voltage regulator.

A separate phenomenon, known as coking, may occur if the tap changer contacts stay on a particular position for an extended period of time. Coking refers to carbon deposits that form on the tap changer contacts. These deposits shorten contact life and may lead to a premature service interruption. Preventing coking from occurring requires that the tap changer contacts be moved, or 'wiped,' periodically. To prevent coking, the tap changer may be tapped to wipe the carbon deposits from the contacts.

SUMMARY

Carbon deposits may accumulate on contacts of a load tap changer operating in one position for an extended period of time. Depending on system conditions, a sequence of tap changes may be executed after the extended period of time to wipe the carbon deposits from the contacts, which reduces the need for contact maintenance. Such a process of changing the position of the tap changer to wipe the carbon deposits from the contacts may be called preventive maintenance tapping (PMT).

Duty cycle monitoring (DCM) is used to maintain estimates of remaining life for the contacts of the load tap changer. An arcing event associated with a change in tap position is detected, and the contacts that are involved in the arcing event are identified. A per-unit loss of life for each of the identified contacts as a result of the detected arcing event is calculated. The per-unit losses of life are used to update estimates of lost life of arcing surfaces of the identified contacts. The updated estimates of lost life are compared to user-defined threshold values, and signals are generated when the updated estimates exceed the threshold values.

In one general aspect, automatically changing the tap position in a load tap changer includes noting a tap position and a duration that the tap position has been held. The duration that the tap position has been held is compared to a threshold value, and the tap position is changed if the tap position has been held for longer than the threshold value.

Implementations may include one or more of the following features. For example, noting a duration that the tap position has been held may comprise noting the value of a countdown timer. The countdown timer may be initially set to the threshold value. The countdown timer may be reset to the threshold value after every change in tap position. Comparing the duration that the tap position has been held to the threshold value may include checking if the value of the countdown timer is zero. The threshold value may be a user configurable parameter. The threshold value may be a number of whole days between 1 and 99.

Changing the tap position may include moving the tap to a position above an initial tap position, moving the tap to a position below the initial tap position, and returning the tap to the initial tap position. The position above the initial tap position may be one position above the initial position. The position below the initial tap position may be one position below the initial position.

Changing the tap position may include moving the tap from an initial tap position and returning the tap to the initial tap position. For example, moving the tap from the initial tap position may include moving the tap one position from the initial position.

Changing the tap position may include moving the tap from an initial tap position to a position above or below neutral and returning the tap to the initial tap position. For example, moving the tap to a position above or below neutral may include moving the tap to one position above or below neutral.

Changing the tap position also may include moving the tap to a position above neutral, moving the tap to a position below neutral, and returning the tap to the neutral position.

Information identifying the change in tap position that was signaled may be recorded. The identifying information may include the time and date of the tap change, as well as the mode used to dictate the change in tap position.

A signal indicating that the tap position is to be changed also may be generated when the tap position has been held for longer than the threshold value. Generating the signal indicating that the tap position is to be changed may include outputting a voltage indicative of a future change in tap position, or sending a digital communication indicative of a future change in tap position.

Changing the tap position also may include noting a present time and checking if the present time is within a specified range of times during which a change in tap position may occur. When the present time is not within the specified range, changing the tap position also includes monitoring the present time until the present time is within the specified range and changing the tap position only after the present time is within the specified range. The range of times during which a change in tap position may occur may be a user configurable parameter, and may be specified by a start time and an end time of the range.

Changing the tap position also may include checking if the present tap position is within a specified range of positions within which a tap change can occur. When the present tap position is not within the specified range, changing the tap position also includes monitoring the present tap position until the present tap position is within the specified range and changing the tap position only after the present tap position is within the specified range. The range of positions within which a tap change can occur may be a user configurable parameter, and may be specified by a single number that defines the absolute value of end positions of the specified range.

Changing the tap position also may include measuring the magnitude of load current flowing through the tap changer and checking if the magnitude is less than a threshold value. When the magnitude is not less than the threshold value, changing the tap position also may include monitoring the magnitude until the magnitude is less than the threshold value and changing the tap position only after the magnitude is less than the threshold value. The threshold value may be a user configurable parameter, and may be specified by a percentage of the maximum rated load current specified for a regulator that includes the load tap changer.

Changing the tap position may include verifying that operating conditions of the load tap changer meet criteria for allowing a change in tap position and changing the tap position when the criteria are met.

A signal indicating that a change in the tap position that should occur also may be received. The tap position may be changed in response to receiving the signal.

In another general aspect, monitoring the life of load tap changer contacts includes detecting an arcing event and identifying arcing surfaces involved in the arcing event. A per-unit loss of life for the identified arcing surfaces as a result of the arcing event is calculated, and estimates of cumulative erosion for the arcing surfaces are updated. The updated estimates of cumulative erosion are compared to a first threshold value, and action is signaled for when at least one of the updated estimates of cumulative erosion exceeds the first threshold value.

Implementations may include one or more of the following features. For example, the estimates of cumulative erosion for the arcing surfaces may be estimates of remaining life of the contacts. The first threshold value may be a minimum allowable remaining life of an arcing surface before service of the arcing surface is required. Signaling for action when at least one of the updated estimates of cumulative erosion exceeds the first threshold value may include signaling for action when at least one of the updated estimates of remaining life is less than the minimum allowable remaining life of a contact.

The estimates of cumulative erosion for the arcing surfaces may be estimates of lost life of the contacts. The first threshold value may be a maximum allowable lost life of an arcing surface before service of the arcing surface is required. Signaling for action when at least one of the updated estimates of cumulative erosion exceeds the first threshold value may include signaling for action when one of the updated estimates of lost life is greater than the maximum allowable lost life.

The load tap changer may include moveable and stationary contacts that each include arcing surfaces. Identifying the contacts involved in the arcing event may include identifying the moveable and stationary contacts involved and may also include identifying arcing surfaces of those contacts.

Calculating the loss of life for the identified arcing surfaces as a result of the arcing event may include calculating an interrupting current and a recovery voltage of the load tap changer. The loss of life for the identified arcing surfaces as a result of the arcing event may be calculated based on the interrupting current and the recovery voltage using a contact life equation that is based on contact life testing of a statistically large number of tap changes at specific interrupting current and recovery voltage levels.

Updating an estimate of the remaining life of the contacts may include retrieving saved estimates of erosion of the contacts, updating the saved estimates to include the loss of life of the arcing surfaces, and saving the updated estimates with the effect of the arcing event included as updated estimates. Including the loss of life of the identified arcing surfaces in the saved estimates may include adding the loss of life of the identified arcing surfaces to the estimates of cumulative erosion for the identified arcing surfaces, or subtracting the loss of life of the identified arcing surfaces from the estimates of cumulative erosion for the identified arcing surfaces.

The updated estimates of cumulative erosion may be compared to a second threshold value that is indicative of service interruption when exceeded. Failure may be signaled for when at least one of the updated estimates of cumulative erosion exceeds the second threshold value.

A time at which maintenance of an arcing surface will be necessary may be estimated. This may include, for example, retrieving an estimate of the cumulative erosion for the arcing surface. A number of arcing events necessary to cause the estimate of the cumulative erosion for the arcing surface to exceed the first threshold value based on a calculated average loss of life per arcing event for the arcing surface may be estimated. A rate at which arcing events occur also may be estimated, and a time at which maintenance on the arcing surface will be necessary may be estimated based on the estimated rate and the estimated number of arcing events.

In another general aspect, a system for automatically changing the position of movable contacts of a load tap changer includes a processor operable to determine a position of movable contacts in a load tap changer of a voltage regulator and an amount of time for which the position has not changed. The system also includes an actuator operable to change the position of the movable contacts. The actuator changes the position of the movable contacts in response to a signal from the processor that the position is to be changed because the movable contacts have not moved for longer than a threshold value.

Implementations may include one or more of the following features. For example, the processor and the actuator may be electrically connected to the load tap changer. The processor may access a clock to determine the amount of time for which the position of the movable contacts have not changed and to determine if the movable contacts have not moved for longer than a threshold value.

A memory operable to store data specifying the position of the movable contacts and the changes to the position of the movable contacts may be included. The data specifying the changes to the position of the movable contacts may include a time, a date, and a mode of operation for each change in the position of the movable contacts.

The processor may be operable to determine a present time. The processor may signal for a change in the position of the movable contacts if the present time is within a specified daily time period.

The processor may be operable to obtain a measurement of the magnitude of the load current flowing through the voltage regulator. The processor may signal for a change in the position of the movable contacts if the current measurement is below a threshold value.

The processor may be operable to send a signal to a subordinate processor and receive a signal from a superior processor. The processor may send a signal to subordinate processors before each change in the position of the movable contacts as a result of there being no changes in the position of the movable contacts for longer than the threshold value. The signal may instruct the subordinate processors to cause a change in a position of movable contacts associated with each of the subordinate processors. The processor may receive a signal from the superior processor and cause a change in the position of the movable contacts in response to the signal.

In another general aspect, a system for monitoring the life of load tap changer contacts includes a processor operable to calculate a loss of life for an arcing surface of a load tap changer as a result of an arcing event. The system also includes a memory operable to store an estimate of cumulative erosion on the arcing surface. The processor includes the loss of life for the arcing surface in the estimate of cumulative erosion stored in the memory and the memory stores the result of the inclusion as an updated estimate of cumulative erosion on the contact.

Implementations may include one or more of the following features. For example, the processor may use current measurements and voltage measurements from the regulator and design parameters of the regulator at the time of the arcing event to calculate the loss of life for the arcing surface. The processor may be operable to signal for maintenance of the load tap changer based on a comparison between the estimate of cumulative erosion on the arcing surface and a threshold value.

Other features will be apparent from the following description, including the drawings and the claims.

DESCRIPTION OF DRAWINGS

Like reference symbols in the various drawings indicate like elements.

DETAILED DESCRIPTION

Figure 1:
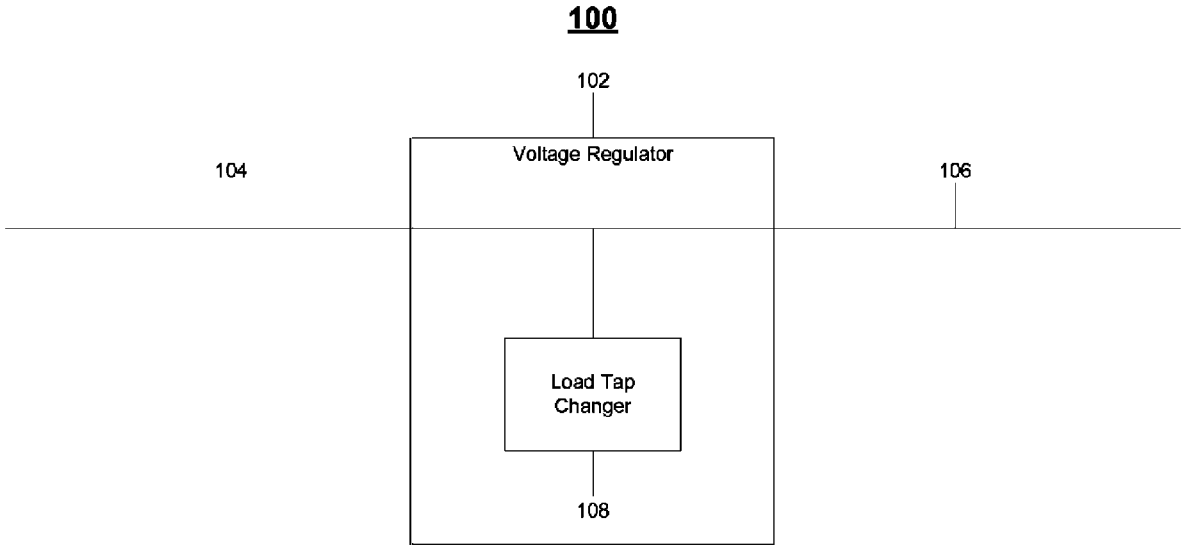
FIG. 1 is a block diagram of an electrical system that includes a load tap changer.

Referring to FIG. 1, an electrical system 100 includes a voltage regulator 102. The voltage regulator 102 monitors the voltage on an output conductor 106 and regulates the voltage on the output conductor 106 to a set level. The output produced by the voltage regulator 102 on the output conductor 106 is a regulated version of the voltage on an input conductor 104. The voltage regulator 102 regulates the voltage of the output by engaging taps of a load tap changer 108 of the voltage regulator 102.

In one implementation, the load tap changer 108 may be a 32-step tap changer that accurately regulates voltage in ⅝% steps from "10% raise" to "10% lower" on distribution circuits rated 2400 volts (60 kV BIL) through 34,500 volts (200 kV BIL) for either 50 or 60 Hz systems. In other implementations, the load tap changer 108 may have a different number of tap positions or a different step size and may be applied to distribution circuits with different ratings.

Figure 2:
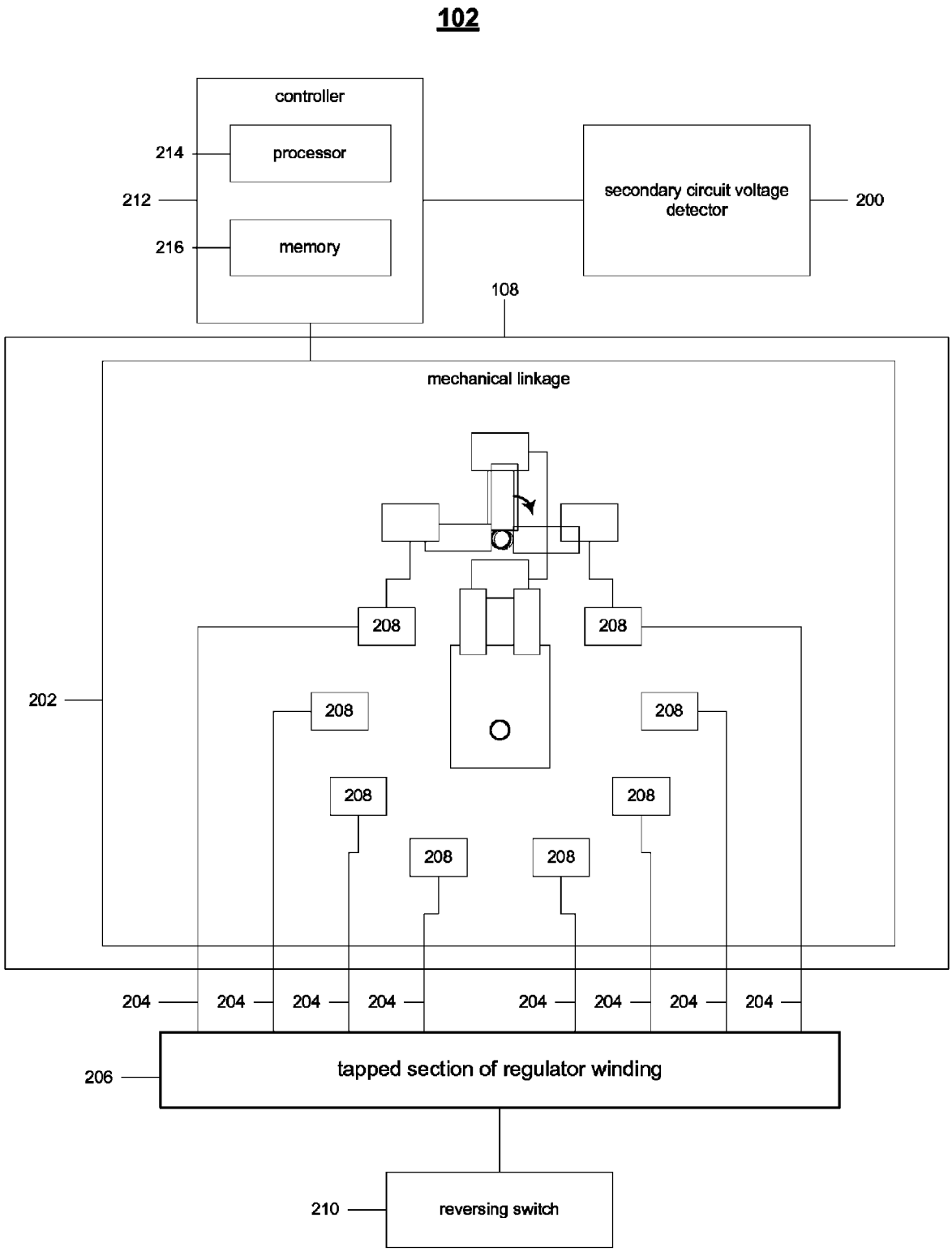
FIG. 2 is a block diagram of a load tap changer.

The voltage regulator 102 uses the load tap changer 108 to control voltage variations due to load changes, or changes to the voltage on the input conductor 104. More particularly, a controller of the voltage regulator 102 uses the load tap changer 108 to control the voltage variations. In other words, the load tap changer 108 may be used to maintain a constant voltage on the output conductor 106 even if the voltage detected on the input conductor 104 changes. As shown in FIG. 2, the load tap changer 108 employs a secondary circuit voltage detector 200 to actuate a mechanical linkage 202 to selectively engage different taps 204 of a tapped section of a winding 206, in response to voltage variations, in order to control the output voltage of the voltage regulator 102. The mechanical linkage 202 includes stationary contacts 208 to which movable contacts of the load tap changer 108 electrically connect to engage the corresponding taps 204. While FIGS. 1 and 2 illustrate a single-phase voltage regulator, tap changers also may be used to control multi-phase systems, such as three-phase systems, and the techniques described below are equally applicable to such systems. In the case of a three-phase system, multiple load tap changers 108 may be used.

In one implementation, the load tap changer 108 may vary the relationship between the input and output voltage of an electrical control device in the range of ±10% from a nominal value. For example, the load tap changer 108 may include sixteen taps 204, each of which adjusts the relationship by ⅝%, such that the total possible adjustment may be up to 10% (that is 16×⅝%). A polarity or reversing switch 210 permits this adjustment to be positive or negative.

The voltage regulator 102 includes a controller 212 that determines when the load tap changer 108 should be used to engage different taps 204 of the winding 206 to control the output voltage of the voltage regulator 102. When such a determination is made, the controller signals the load tap changer 108 to change the tap position, and the load tap changer 108 responds by changing the tap position. The controller 212 receives voltage and current measurements from the voltage regulator 102 to aid in determining when to change the tap position. A current transformer or sensor provides current measurements to the controller 212, and a potential transformer or sensor provides voltage measurements to the controller 212. The current transformer and the potential transformer may be included within the voltage regulator 102 or may be external to the voltage regulator 102. In some implementations, the voltage regulator 102 uses two potential transformers or sensors.

The controller 212 includes a processor 214 that processes machine-executable instructions and a memory 216 that stores information needed by the processor 214. The processor 214 performs calculations based on the current and voltage measurements and other signals, such as tap changer direction, and stores the results of those calculations in the memory 216. The controller 212 runs one or more clock processes that are accessible by other processes running in the controller 212.

The processor 214 executes multiple processes for monitoring and maintaining the load tap changer 108 within the voltage regulator 102. For example, the processor 214 executes a preventive maintenance tapping (PMT) process and a duty cycle monitoring (DCM) process to increase the life of the tap changer 108 and decrease the number of planned or unplanned service interruptions. The preventive maintenance tapping process lengthens contact life by preventing coking from occurring. By calculating erosion-to-date and remaining life of the contacts, the duty cycle monitoring process enables better scheduling of maintenance such that maintenance is not performed too often, but is performed often enough to prevent unplanned outages.

The movable contacts of the tap changer 108 may stay in a particular position for extended periods of time when the voltage on the input conductor 104 remains constant, when changes in tap position are explicitly prevented, or for other reasons. As noted above, when the movable contacts remain in one position for such extended periods, coking may occur. Manual tap changes may be made in an attempt to extend the contact life, but these changes are made without the knowledge of the duration of tap changer inactivity.

Figure 3:
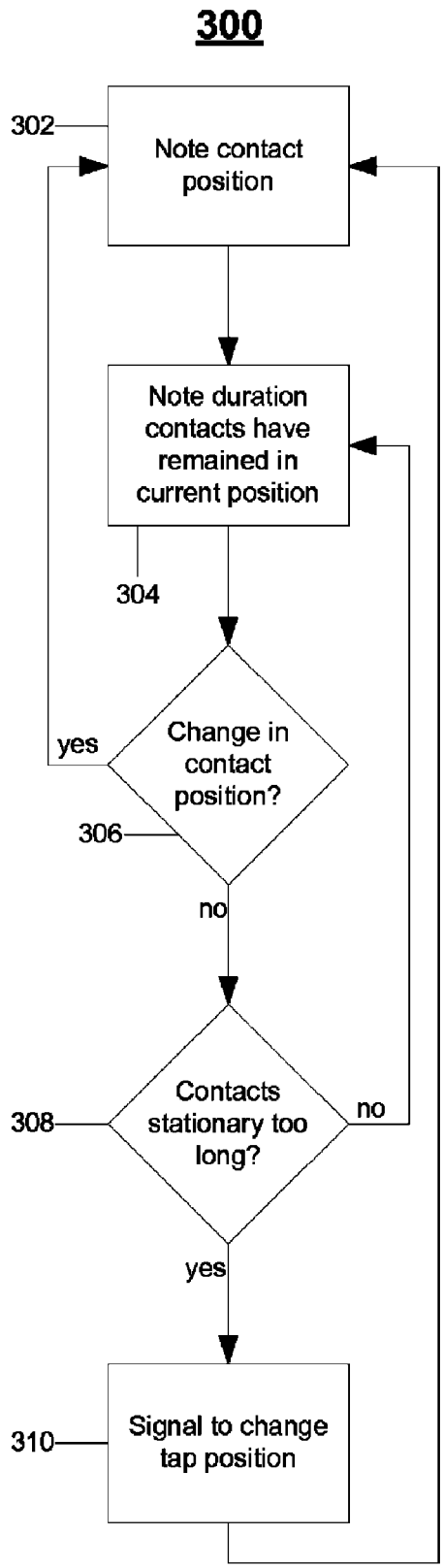
FIG. 3 is a flow chart of a process for preventive maintenance tapping in a load tap changer.

Referring to FIG. 3, in order to prevent carbon buildup on the movable contacts, a preventive maintenance tapping process 300 causes the tap position to change after a set of criteria, including the time of tap changer inactivity, are met. The process 300 is executed by, for example, the processor 214 of the controller 212. The process 300 signals for a change in tap position when the tap changer has been in one tap position for longer than a threshold amount of time. There may be multiple modes for changing the tap position after the contacts have been in one tap position for too long.

Initially, the present position of the load tap changer contacts is noted (302), and the duration for which the contacts have been at that position is monitored (304). For example, in one implementation, countdown timers are used to monitor the time period during which the contacts have been in one tap position. In one implementation, the timers indicate an amount of time in days remaining before the tap position should be changed. The countdown timers may be initially set to the maximum time allowed between tap changes, which, in the noted implementation, is a configurable parameter that can take on any number of whole days between 1 and 99 (though other implementations may use other values and ranges). The countdown timers are accessible by way of the human-machine interface (HMI) and the communication interface of the controller.

If the tap position is subsequently changed (306), due to a variation in the input voltage or output voltage of the voltage regulator, or for other reasons, the new contact position is noted (302). The countdown timer is reset to the maximum time allowed between tap changes and is used to monitor the duration for which the tap changer has not changed position (304).

If no change in the position of the tap changer is detected, but the tap changer has been at its present position for less than the time limit (308), the process 300 continues to monitor the time for which the tap changer has been at its present position. In general, a countdown timer having a nonzero value indicates that the tap changer has been at its present position for less than the time limit.

If the movable contacts of the tap changer have remained in one position for more than the time limit (308) (i.e., the countdown timers have zero values), the processor 214 causes the controller 212 to signal for a preventive maintenance tapping sequence that causes a change in the tap position (310). A user may govern the way in which the tap position is changed by selecting a particular mode. Each mode may be independently turned off and on, such that any number of the modes may be used.

Before the preventive maintenance tapping sequence begins, the time, date and mode to be used are recorded by the controller 212. In one implementation, a simple mode, called mode A, limits maintenance tapping to a range not to exceed one tap higher or one tap lower than the initial tap position. Let N be the tap changer position when a preventive maintenance tapping sequence is starting according to the simple mode A. In one implementation of the simple mode, the tap is raised to position N+1, and then is lowered to position N−1 before being returned to the initial position N. In another implementation of the simple mode, the tap is raised to position N+1, and then is returned to the initial position N. In yet another implementation of the simple mode, the tap is lowered to position N−1 before being returned to the initial position N. In general, the simple mode may be used to move the tap changer into a non-restricted tap position before returning to the initial position.

A more complex mode, called mode B, is intended to operate the tap changer's internal reversing switch as long as a series of criteria have been met. When mode B is selected and a preventive maintenance tapping sequence is started, the tap changer position is moved through a neutral position to operate the reversing switch. The number of positions through which the tap changer moves depends on the initial tap position. For example, if the tap position initially represents a raise from the neutral position, the tap position will be lowered to one step below the neutral position before being raised back to the original position. On the other hand, if the tap position is initially in a position lower than the neutral position, the tap position will be raised to one step above the neutral position before being lowered back to the original position. If the tap position is initially in the neutral position, the tap position is moved one position above the neutral position and then one position below the neutral position before the tap position is returned to the neutral position. More generally, mode B does not limit the positions of the load tap changer to which the tap may be moved, so the tap may be moved to any position when mode B is used. These sequences of movements are all designed to operate the reversing switch in the load tap changer, thereby abrading carbon deposits, which result from coking, from the contacts of the reversing switch.

The preventive maintenance tapping process 300 employs a configurable time-of-day range parameter that defines the acceptable time frame during which a preventive maintenance tapping sequence may be initiated. If the countdown timer expires during a period of time that is not within the time-of-day range parameter, the preventive maintenance tapping sequence that has been signaled remains pending until a time of day within the time of day range parameter is reached. The time of day range parameter includes a start time and an end time. In one implementation, the times may take values within the range between 00:00 to 23:59 that represent valid times. The start time defines the beginning of the range of times during which a preventive maintenance tapping sequence may be initiated, and the end time defines the end of the range.

A second parameter used by the preventive maintenance tapping process 300 is the maximum deviation from the neutral position parameter, which defines the absolute value of the outer tap position limits, beyond which the controller will not initiate a mode B preventive maintenance tapping sequence. For example, if the maximum deviation from the neutral position parameter is set to 5 and the tap changer is at a tap position of −7, the preventive maintenance tapping sequence that has been signaled will remain pending until the tap changer has taken a position within the range allowed by the maximum deviation from the neutral position parameter, which is −5 to +5 in this case. For a load tap changer having 16 taps, the maximum deviation from the neutral position parameter may take an integral value between 1 and 16.

A current limit parameter may also be considered when executing a preventive maintenance tapping sequence. The current limit parameter prevents the initiation of a preventive maintenance tapping sequence when the load current exceeds the indicated threshold. This user-configurable parameter takes the form of a percentage of the maximum rated load current of the voltage regulator.

Figure 4:
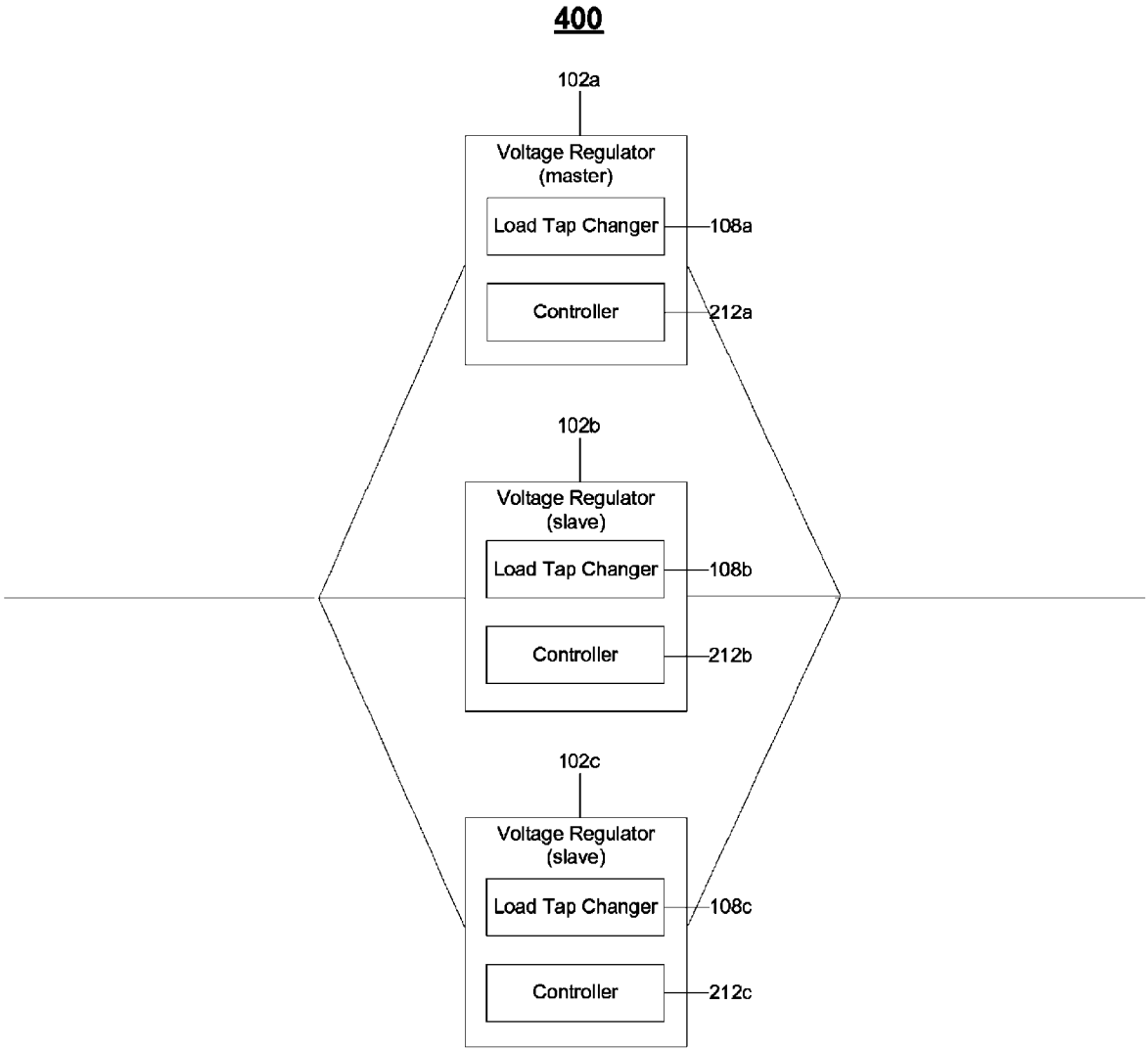
FIG. 4 is a block diagram of a multi-phase electrical system that includes multiple load tap changers.

The controller of the voltage regulator may have an input and an output through which communication with controllers of other voltage regulators may occur. For example, in the multi-phase electrical system 400 shown in FIG. 4, voltage regulators 102*a*-102*c* each include one of the load tap changers 108*a*-108*c*. The voltage regulators 102*a*-102*c* also each include one of the controllers 212*a*-212*c*. One of the voltage regulators, such as the voltage regulator 102*a*, may be designated as a superior voltage regulator, while the other voltage regulators, such as the voltage regulators 102*b* and 102*c*, may be designated as subordinate voltage regulators. In such a configuration, the controller 212*a* may be designated as a superior controller, and the controllers 212*b* and 212*c* may be designated as subordinate controllers. Similarly, the load tap changer 108*a* may be designated as a superior load tap changer, and the load tap changers 108*b* and 108*c* may be designated as subordinate load tap changers. The controller 212*a* of the superior voltage regulator 102*a* may send a signal over the corresponding output that signals the controllers 212*b* and 212*c* of the subordinate voltage regulators 102*b* and 102*c* that the superior controller 212*a* has initiated a preventive maintenance tapping sequence. After receiving this signal on the respective inputs, the controllers 212*b* and 212*c* signal for preventive maintenance tapping sequences in the subordinate load tap changers 108*b* and 108*c*.

In one implementation, a single voltage may be produced on the output of the superior controller 212*a* to indicate that a PMT sequence for the superior load tap changer 108*a* has been initiated. More particularly, a presence of voltage on the output indicates that the PMT sequence has been initiated and that the tap position of the load tap changer 108*a* will be changed. In another implementation, a digital communication may be sent over the output of the controller 212*a*. The digital communication may indicate that the PMT sequence has been initiated and may include details of the change in tap position to be made. The controllers 212*b* and 212*c* of the subordinate voltage regulators 102*b* and 102*c* may use the included details to specify how the tap positions of the subordinate load tap changers 108*b* and 108*c* should be changed. Sending the signals indicating that the PMT sequence has been initiated before the tap position of the superior load tap changer 108*a* has changed enables the load tap changers 108*a*-108*c* to change tap positions are substantially the same time.

Within this feature, the superior controller 212*a* performs the preventive maintenance tapping process 300 based on the internal configuration of the superior load tap changer 108*a*. The subordinate controllers 212*b* and 212*c*, on the other hand, do not perform the preventive maintenance tapping process 300 based on the internal configuration of the subordinate load tap changers 108*b* and 108*c*. Instead, the subordinate controllers 212*b* and 212*c* only initiate a preventive maintenance tapping sequence when the appropriate signal is received from the superior controller 212*a* on inputs of the subordinate controllers 212*b* and 212*c*. In other implementations, a single controller may directly control multiple load tap changers.

The preventive maintenance tapping sequence may be limited by hardware and firmware control settings. For example, if the control function switch of the controller is in the "Off" or "Manual" position, initiation of a preventive maintenance tapping sequence is physically disabled, and will not begin until the control function switch is returned to the "Auto/Remote" position and other criteria for starting a PMT sequence are met. The preventive maintenance tapping range may be limited by physical constraints, such as limit switches on the load tap changer or in the position indicator, and firmware parameters, such as SOFT-ADD-AMP limits and the tap-to-neutral feature. If so, the preventive maintenance tapping sequence does not attempt to exceed those limits. If the tap-to-neutral feature is active, the tap position is not changed.

The user may issue a manual command to cause the tap changer to perform a preventive maintenance tapping operation, using any of the available modes, before the countdown timers have expired. This allows the user to bypass the preventive maintenance tapping process 300 to cause a change in tap position when necessary. In one implementation, the manual command may be issued through the HMI. In another implementation, the command may be issued through a communications device, such as a mobile computing device, that is capable of connecting to the controller of the voltage regulator and signaling for a preventive maintenance tapping operation. In another implementation, a supervisory control and data acquisition (SCADA) system may be used to issue the command to the controller.

The preventive maintenance tapping process may extend the life of the contacts by preventing carbon build up on contact surfaces. The mechanical contact wiping action that takes place during a tap change sequence will reduce the amount of coking that occurs. This will result in lower lifetime maintenance costs and an extended lifetime for the voltage regulator.

In general, load tap changer contact life previously has been monitored through visual inspection. To do so, a regulator that includes a load tap changer and the associated contacts is removed from service for visual inspection of the contacts. When removed from service, the regulator may be bypassed without being replaced, in which case the circuit voltage is no longer regulated by the voltage regulator, and the equipment on the circuit is exposed to unregulated voltage. The removed regulator also may be bypassed and replaced, which is resource intensive and undesirable if not necessary. If the regulator is not bypassed, the line serviced by the regulator is de-energized, which results in a loss of power to the equipment on the circuit. In addition, the regulator may need to be taken to a service facility for maintenance work, which increases the duration of the power outage.

Monitoring the number of tap change operations in an attempt to determine when contacts should be serviced provides some degree of knowledge about how often arcing events are occurring, but excludes details regarding amount of contact erosion on each arcing edge and the conditions to which the contacts were exposed. The conditions to which the contacts were exposed are important factors in determining the effects of an arcing event on the life expectancy of the contacts.

Figure 5:
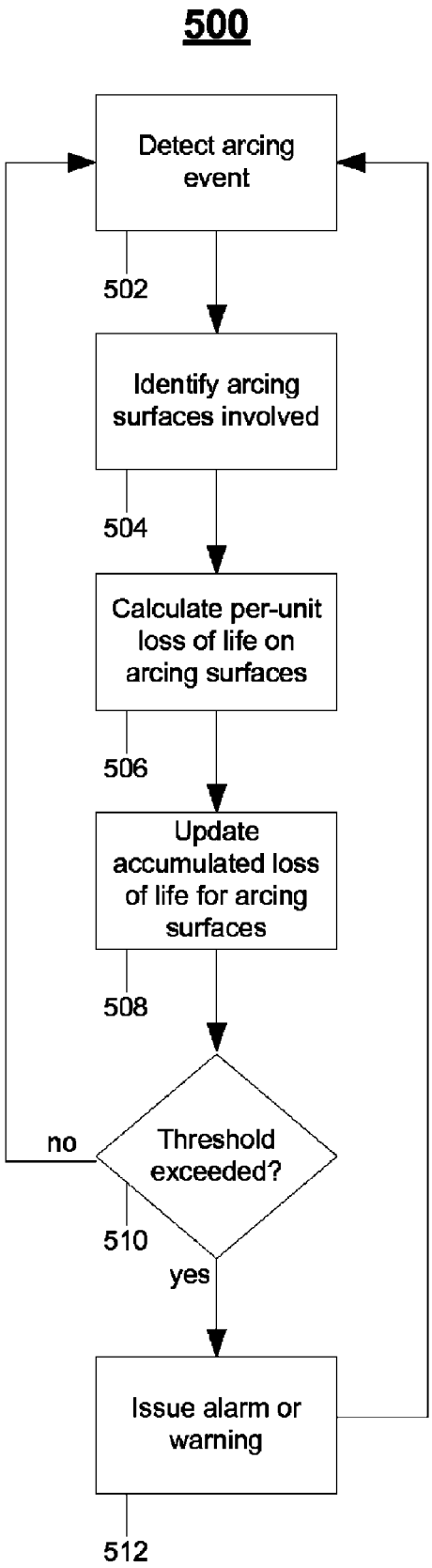
FIG. 5 is a flow chart of a process for duty cycle monitoring of load tap changer contacts.

Referring to FIG. 5, a duty cycle monitoring process 500 estimates lost life for all arcing surfaces of contacts in a load tap changer of a voltage regulator. When the estimated lost life for any arcing surface exceeds user defined thresholds, alarms or warnings are provided by way of a controller of the regulator such that a user may plan for equipment maintenance at an appropriate time to have the aged tap changer contacts replaced. The alarms or warnings provided during the duty cycle monitoring process 500 allow the user to optimally schedule maintenance and avoid service interruptions on circuits connected to the regulator.

The process 500 for calculating accumulated loss of contact life uses data from tap changer contact life testing. From test data on specific tap changer models, contact life can be related to interrupting current and recovery voltage. The magnitudes of these values are functions of circuit parameters, tap position, direction of tap changer travel and design information specific to the regulator.

Arcing events result in a volume of material eroded from contacts involved in the arcing event. If a statistically large number of tap changes at a constant interrupting current and recovery voltage are made starting with new contacts and continuing to complete erosion, an average per-unit loss of life per arcing event may be calculated for that specific interrupting current and recovery voltage. Data points of contact life at different interrupting current and recovery voltage levels enable a set of contact life curves for a specific tap changer model to be created and a contact life equation to be written.

The process 500 begins with the detection of an arcing event (502). An arcing event occurs with every tap change, so the controller identifies the arcing event by detecting a tap change. During a tap change, current is interrupted at a first arcing surface and established at a second arcing surface, but service to the circuit to which the regulator is connected is not interrupted at this time. As current is interrupted at the first arcing surface, an arc occurs, which erodes a portion of the contact material volume.

Arcing surfaces involved in the detected arcing event are identified so that the per-unit loss of life caused by the arcing event may be attributed to those arcing surfaces (504). Arcing surfaces of two types of tap changer contacts, movable contacts and stationary contacts, are considered. The movable contacts make electrical contact with appropriate stationary contacts to adjust a turns ratio of the regulator such that a relatively constant regulated voltage is maintained. The load tap changer includes two sets of movable contacts, and each set of movable contacts includes two arcing surfaces. In addition, each stationary contact has two arcing surfaces. All arcing surfaces of the movable and stationary contacts are monitored during the process 500. One movable and one stationary arcing surface are involved in each arcing event. When a tap change is made, the controller identifies the movable and stationary contact arcing surfaces involved in the arcing event based on the tap changer position prior to the tap change and the direction of travel of the tap changer.

After the involved arcing surfaces are identified, the interrupting current and recovery voltage are calculated by the controller. As stated previously, the magnitudes of the interrupting current and the recovery voltage are functions of circuit parameters, tap position, direction of tap changer travel and design information specific to the regulator. Circuit parameters are provided to the controller by ancillary devices such as potential or current transformers. Tap position and direction of travel are detected by the controller through signals provided by the tap changer. Specific regulator design information is provided as an input to the controller.

The per-unit loss of contact life for the arcing surfaces involved in the arcing event is calculated using a contact life equation (506). The contact life equation was developed using contact life test data for specific tap changer models, as described above. The contact life equation is a function of interrupting current and recovery voltage and uses constants determined from the contact life test data.

The per-unit loss of life for the specific arcing surfaces is calculated and accumulated for both movable and stationary contacts in memory maintained by the controller. Subsequent events are cumulative, and a loss of life resulting from an arcing event is added to the running estimates of lost life for every arcing surface involved in the arcing event. For each contact arcing surface involved in the arcing event, the new accumulated estimates of lost life for each contact is stored in the memory of the controller (508).

The updated estimates of lost life are checked against user defined threshold values (510). If the accumulated estimates for any arcing surface exceeds a user-defined threshold value, the regulator signals by way of the controller that user action is required (512). For example, the controller may indicate that a threshold has been exceeded through the HMI, SCADA, or through operation of a set of alarm contacts. In one implementation, two user-defined thresholds are used. One threshold is intended to indicate to the user that equipment maintenance needs to be scheduled. A second threshold is set at a higher level and is intended to notify the user that a service interruption caused by the regulator may be imminent. After a warning or alarm is given, the process 500 continues and loss of life continues to be accumulated. If no accumulated estimates of lost life exceeds any threshold level, no alarms or warnings are given, and the process 500 continues.

The duty cycle monitoring process 500 is executed for each arcing event that occurs within the tap changer. Monitoring the lost life of the contact arcing surfaces and signaling when thresholds are exceeded results in improved maintenance scheduling and less service interruptions caused by complete erosion of the tap changer contacts. The user may reset the estimates of lost life of all arcing surfaces after the contacts are replaced and the regulator is returned to service. In addition, a user may input initial accumulated estimates of lost life for the arcing surfaces when a controller is placed on a regulator that has been in service for some time such that the tap changer has experienced arcing. In such a case, the user specifies the accumulated estimates of lost life on the contact arcing surfaces and inputs the estimates into the controller.

In other implementations, the remaining arcing surface life may be estimated instead of the accumulated loss of life. In such an implementation, the calculated per-unit loss of life for the contacts involved in the detected arcing event is subtracted from the estimate of remaining arcing surface life for the involved arcing surfaces. In addition, the controller may estimate a date on which maintenance is needed or a date of the end of life for a contact. More particularly, historical parameters including regulator loading, voltage levels, tap changer activity, and tap range may be monitored used to calculate an average loss of life per arcing event for the involved arcing surfaces. The contact life equation may be used to calculate an expected remaining life of the contact arcing surfaces. A maintenance or end of life date then may be calculated using the typical circuit and tap changer activity values, assuming tap changer activity and circuit parameters remain fairly constant since historical values are used.

A voltage regulator is used throughout to refer generically to an electrical device that detects a voltage on an input and produces a corresponding, regulated voltage on an output. The voltage regulator may be a step-type voltage regulator or an induction-type voltage regulator. Furthermore, the term "voltage regulator" may refer to a transformer that transforms a voltage detected on an input into a voltage on an output. The transformer may be a load tap changing (LTC) transformer or a tap changing under load (TCUL) transformer. The voltage regulator may be, for example, a single-phase regulator, a multi-phase regulator, an auto-transformer regulator, or a two-winding regulator. The tap of the voltage regulator may include any number of steps, including zero, as in the case of an induction-type regulator.

It will be understood that various modifications may be made. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A method for monitoring the life of load tap changer contacts, the method comprising:
detecting an arcing event;
identifying arcing surfaces involved in the arcing event;
calculating a per-unit loss of life for the identified arcing surfaces as a result of the arcing event;
updating estimates of cumulative erosion for the arcing surfaces based on the calculated per-unit loss of life;
comparing the updated estimates of cumulative erosion to a first threshold value; and
signaling for action when at least one of the updated estimates of cumulative erosion exceeds the first threshold value.

2. The method of claim 1 wherein:
the estimates of cumulative erosion for the arcing surfaces are estimates of remaining life of the contacts;
the first threshold value is a minimum allowable remaining life of an arcing surface before service of the arcing surface is required; and
signaling for action when at least one of the updated estimates of cumulative erosion exceeds the first threshold value comprises signaling for action when at least one of the updated estimates of remaining life is less than the minimum allowable remaining life of the arcing surface.

3. The method of claim 1 wherein:
the estimates of cumulative erosion for the arcing surfaces are estimates of lost life of the contacts;
the first threshold value is a maximum allowable lost life of an arcing surface before service of the arcing surface is required; and
signaling for action when at least one of the updated estimates of cumulative erosion exceeds the first threshold value comprises signaling for action when one of the updated estimates of lost life is greater than the maximum allowable lost life.

4. The method of claim 1, wherein:
the load tap changer includes moveable and stationary contacts that each include arcing surfaces; and
identifying the contacts involved in the arcing event comprises:
identifying the moveable contacts involved;
identifying the stationary contacts involved; and
identifying arcing surfaces of the identified movable contacts and of the identified stationary contacts as involved in the arcing event.

5. The method of claim 1, wherein calculating the loss of life for the identified arcing surfaces as a result of the arcing event comprises:
calculating an interrupting current of the load tap changer;
calculating a recovery voltage of the load tap changer; and
calculating the loss of life for the identified arcing surfaces as a result of the arcing event based on the interrupting current and the recovery voltage using a contact life equation that is based on contact life testing of at least two tap changes at specific interrupting current and recovery voltage levels.

6. The method of claim 1, wherein updating the estimates of the cumulative erosion for the arcing surfaces comprises:
retrieving saved estimates of erosion of the identified arcing surfaces;
updating the saved estimates to include the calculated per-unit loss of life for the identified arcing surfaces; and
saving the updated estimates with the effect of the arcing event included as updated estimates.

7. The method of claim 6 wherein the estimates of cumulative erosion for the identified arcing surfaces are estimates of loss of life of the arcing surfaces, and including the loss of life of the identified arcing surfaces in the saved estimates comprises adding the calculated per-unit loss of life of the identified arcing surfaces to the estimates of cumulative erosion for the identified arcing surfaces.

8. The method of claim 6 wherein the estimates of cumulative erosion for the identified arcing surfaces are estimates of remaining life of the arcing surfaces, and including the loss of life of the identified arcing surfaces in the saved estimates comprises subtracting the calculated per-unit loss of life of the identified arcing surfaces from the estimates of cumulative erosion for the identified arcing surfaces.

9. The method of claim 1 further comprising:
comparing the updated estimates of cumulative erosion to a second threshold value that is indicative of a service interruption when exceeded; and
signaling for a service interruption when at least one of the updated estimates of cumulative erosion exceeds the second threshold value.

10. The method of claim 1 further comprising estimating a time at which maintenance of an arcing surface will be necessary.

11. The method of claim 10 wherein estimating a time at which maintenance of an arcing surface will be necessary comprises:
retrieving an estimate of the cumulative erosion for the arcing surface;
estimating a number of arcing events necessary to cause the estimate of the cumulative erosion for the arcing surface to exceed the first threshold value based on a calculated average loss of life per arcing event for the arcing surface;
estimating a rate at which arcing events occur; and
estimating a time at which maintenance on the arcing surface will be necessary based on the estimated rate and the estimated number of arcing events.

12. A system for monitoring the life of load tap changer contacts, the system comprising:
a processor operable to calculate a loss of life for an arcing surface of a load tap changer as a result of an arcing event; and
a memory operable to store an estimate of cumulative erosion on the arcing surface;
wherein the processor includes the calculated loss of life for the arcing surface in the estimate of cumulative erosion stored in the memory and the memory stores the estimate of cumulative erosion as an updated estimate of cumulative erosion on the arcing surface.

13. The system of claim 12 wherein the processor uses current measurements and voltage measurements from the regulator and design parameters of the regulator at the time of the arcing event to calculate the loss of life for the arcing surface.

14. The system of claim 12 wherein the processor is operable to signal for maintenance of the load tap changer based on a comparison between the estimate of cumulative erosion on the arcing surface and a threshold value.

15. The system of claim 14 wherein:
the estimate of cumulative erosion for the arcing surface is an estimate of remaining life of the arcing surface;
the threshold value is a minimum allowable remaining life of an arcing surface before service of the arcing surface is required; and
to signal for maintenance of the load tap changer based on a comparison between the estimate of cumulative erosion on the arcing surface and a threshold value comprises to signal for maintenance when the of remaining life is less than the minimum allowable remaining life.

16. The system of claim 14 wherein:

the estimate of cumulative erosion for the arcing surface is an estimate of lost life of the arcing surface;

the threshold value is a maximum allowable lost life of an arcing surface before service of the arcing surface is required; and to signal for maintenance of the load tap changer based on a comparison between the estimate of cumulative erosion on the arcing surface and a threshold value comprises to signal for maintenance when the estimate of lost life is greater than the maximum allowable lost life.

17. The system of claim 12, wherein the arcing surface comprises at least a portion of one or more of the load tap changer contacts.

18. The system of claim 12 wherein the processor is further operable to:

detect an arcing event;

identify arcing surfaces involved in the arcing event;

calculate a per-unit loss of life for the identified arcing surfaces as a result of the arcing event; and update estimates of cumulative erosion for the arcing surfaces based on the calculated per-unit loss of life.

* * * * *